United States Patent [19]

Bertaud et al.

[11] Patent Number: 4,494,663

[45] Date of Patent: Jan. 22, 1985

[54] STERILE SOLUTION CONTAINER

[75] Inventors: Francois X. Bertaud, Libertyville; Hans J. Siedler, Gurnee, both of Ill.

[73] Assignee: Abbott Laboratories, North Chicago, Ill.

[21] Appl. No.: 568,325

[22] Filed: Jan. 5, 1984

[51] Int. Cl.[3] ..... B65D 41/32

[52] U.S. Cl. ..... 215/232; 215/250; 215/253

[58] Field of Search ..... 215/232, 250, 252, 253, 215/254, 256, 258

[56] References Cited

U.S. PATENT DOCUMENTS

| | | | |
|---|---|---|---|
| 3,245,858 | 4/1966 | Negoro | 156/423 |
| 3,810,558 | 5/1974 | Crisp et al. | 215/250 X |
| 4,093,093 | 6/1978 | Fowles et al. | 215/232 X |
| 4,111,325 | 9/1978 | Bellamy et al. | 215/253 X |
| 4,176,755 | 12/1979 | Winchell | 215/32 |
| 4,181,232 | 1/1980 | Bellamy et al. | 215/232 |
| 4,236,646 | 12/1980 | Ganz, Jr. et al. | 215/253 X |
| 4,378,891 | 4/1983 | Fowles et al. | 215/32 |
| 4,434,904 | 3/1984 | D'Amico et al. | 215/232 X |

*Primary Examiner*—Steven M. Pollard

*Attorney, Agent, or Firm*—Alan R. Thiele; Neil E. Hamilton

[57] ABSTRACT

A tamperproof sterile solution closure system which will permit the machine assembly of the closure cap to the container without engagement of the threads of the cap with the container threads. The screw type cap member has internal threading, a tear-away portion and a skirt portion. The container has an abutment surface for sealable contact with the skirt portion and in a position such that the threads in the cap and on the neck are not engaged. To activate the closure, a tear-away portion is removed which will allow the threads to engage. Simultaneously, a contact portion on the cap will engage a weakened flange in the neck to cause it to be separated. A projection extending from the cap is positioned in an annular recess in the cap to serve as a captive means for the separated dome portion of the cap for replacement purposes.

20 Claims, 5 Drawing Figures

STERILE SOLUTION CONTAINER

BACKGROUND OF THE INVENTION

This invention relates to a tamperproof closure system for molded plastic containers with sterile solutions. More particularly, the invention relates to a break-away closure for a sterile solution container wherein an outer cap, which will afford a break-away feature, can be machine assembled on the bottle neck without threads prematurely engaging, yet can form a sterile environment seal for the container neck area.

Previously, cap opening devices of the type concerned with in this invention have been sealed to a bottle flange by means of interference fitment gaskets, O-type sealing rings, hot melt procedures, or with tape. These systems do not provide consistently a sterile environment at or around the bottle opening until first use. The use of spin or ultrasonic welding techniques offers a sterile environment between a threaded outer cap and the threaded bottle neck. However, threaded engagement of the bottle and the cap must be avoided and a means must be provided to retain the cap when a portion of the container is severed. In U.S. Pat. No. 3,245,858, the spin welding of a plastic closure is illustrated. In U.S. Pat. Nos. 4,176,755 and 4,378,891 a pre-engagement of the threads of the outer cap with the container is illustrated, or a jacking ring is employed in conjunction with the inner closure.

The prior art does not provide a tamperproof closure system for threaded molded plastic containers wherein the outer cap can be machine assembled and sealed onto the threaded container neck without premature engagement of the threads between the cap and the container, yet will permit a severing of a portion of the container and captively hold it for reclosure purposes after severing.

It is an advantage of the present tamperproof closure system to provide a sterile closure feature with a severing type cap which can be machine assembled onto a container. Other advantages are a closure cap which prevents the accidental stressing of the container frangible section until the tear-away portion is removed; a closure cap which will not prematurely engage the threads on the container, yet will afford a captive function after a portion of the container is severed; a tamperproof and severing closure system which obviates the necessity for additional seals and sealing techniques; and a tamperproof closure system which can be molded from molding equipment without substantial alteration and can be machine assembled by standard assembly machines.

SUMMARY OF THE INVENTION

The shortcomings of the prior art and the foregoing advantages are accomplished by the present threaded tamperproof closure system for a molded plastic container which has a threaded container neck and is capable of being secured to the container neck without threadable engagement. A screw-type cap member has internal threading, a tear-away portion, and a skirt portion for sealable contact with an abutment surface on the container neck. The container has a breakaway portion in the container neck and the cap a contact portion for contact with the breakaway portion. Upon removal of the tear-away portion, the threads of the cap and the container neck will engage, as will the contact portions, to sever the dome section of the container neck. Captive means are provided between the cap and the container neck to hold the severed dome portion in the cap for reclosing purposes. Prior to the threads being engaged, the threads are placed in a spaced apart position which permits the cap to be preferably spin-welded or ultrasonically welded to the container neck without premature activation of the closure system. In a preferred manner, the tear-away portion is provided by an annular weakened band and the container neck includes a dome with the captive means provided by an annular recess in the dome and a projection extending from the cap for interference fitment therein. Also preferably, the break-away portion is provided by a flange extending from the dome and includes a ledge for contact with the contact portion of the cap. Also preferably, the break-away portion is in part provided by a groove connecting the flange with the cap and is positioned opposite the ledge portion.

BRIEF DESCRIPTION OF THE DRAWINGS

A better understanding of the present tamperproof closure system will be afforded by reference to the drawings wherein.

DESCRIPTION OF THE PREFERRED EMBODIMENT

Figure 1:
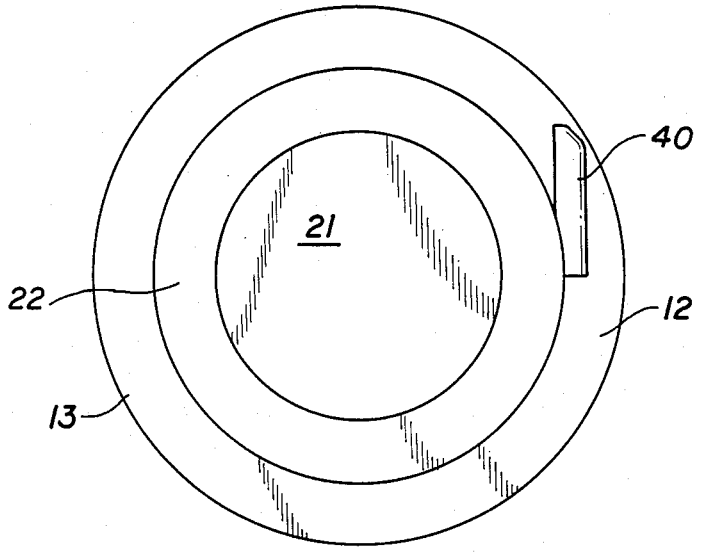
FIG. 1 is a top plan view of the closure system of this invention.
Figure 2:
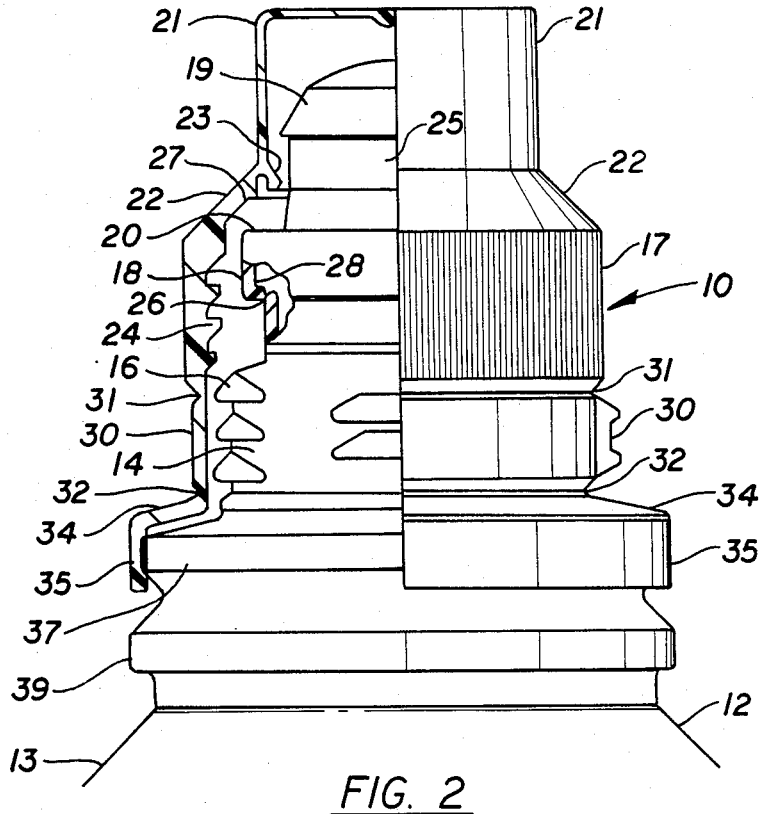
FIG. 2 is a view in side elevation with a portion shown in vertical section illustrating the tamperproof closure system.

Referring to FIGS. 1 and 2, the tamperproof closure system generally 10 includes a semi-rigid plastic container 12 having a shoulder 13 with a neck 14 extending therefrom. External threads 16 are disposed on neck 14 with the neck being closed by a dome portion 19. A ledge 20 extends transversely between threads 16 and dome portion 19. Positioned over neck 14 and dome 19 is a screw cap 22. Screw cap 22 has a dome portion 21 and an annular projection 23 extending into recess 25 provided by dome 19 and ledge portion 20. Extending downwardly from ledge portion 20 is a flange portion 18 interconnected to neck 14 through a groove 26. Extending downwardly from dome 21 in cap 22 is an angular portion 27. Internal threads 24 extend from cap 22 and are complementary and engageable with threads 16 on neck 14. A band section 30 is interconnected to cap 22 through weakened portions 31 and 32. A skirt 35 engages flange 37 of container 12 and is interconnected to cap 22 through shoulder 34. An additional flange 39 is provided for the purpose of supporting the container during assembly. A pull tab 40 extends tangentially from band 30 and a knurled portion 17 is disposed on the outer surface of cap 22.

Container 12 with neck 14 will be fabricated by common blow molding and sealing procedures. Closure 22 will be manufactured by injection molding a thermoplastic material. Cap 22 will be placed over container neck 14 as well as dome 19 in the manner shown in FIG. 2 by ordinary spin welding techniques. This will be accomplished as container neck 14 is formed from a thermoplastic resinous material such as polypropylene which, when skirt 35 is spin welded thereon, will cause it to fuse thereto in a heat fusion weld. Those knowledgeable in the art will recognize that after minimal modifications in the mating surfaces, a similar fusion weld can also be effected by high frequency and small amplitude vibration of the cap with respect to the container commonly known as ultrasonic welding. It will be appreciated that when container 12 is blow molded, it will also be filled with a liquid then sealed. Accordingly, container 12 is commonly referred to as a blow-fill-seal container. While the container can be aseptically filled with sterile fluid, the container-cap system can be sterilized after assembly thus providing not only for sterile contents but also sterility of the surfaces which either come into contact with the contents or with the fitments and accessories frequently used in the delivery of medical solutions.

OPERATION

Figure 3:
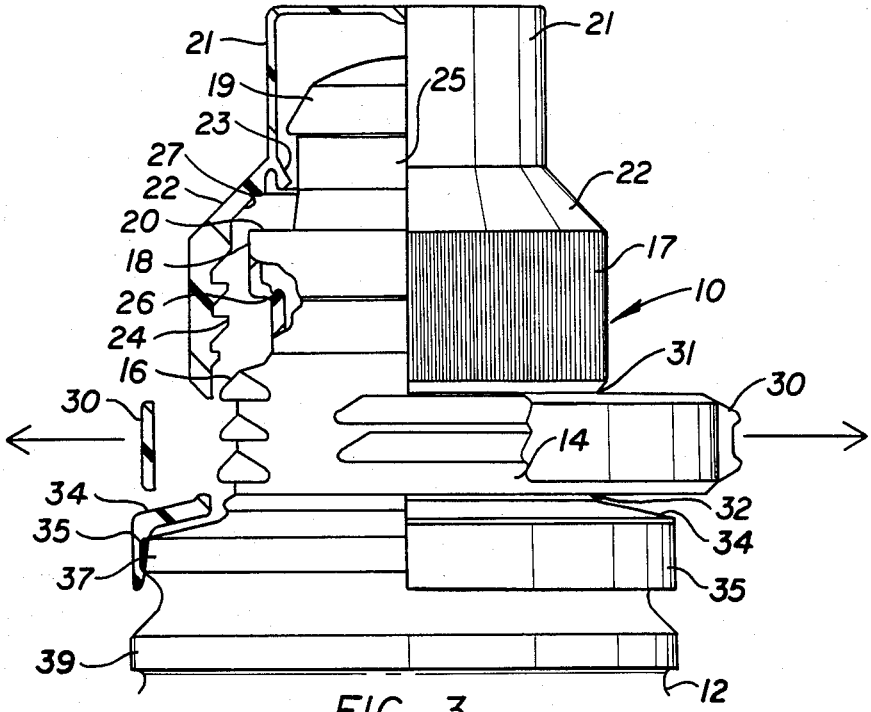
FIG. 3 is a view similar to FIG. 2 showing the first step in activating the closure system.
Figure 4:
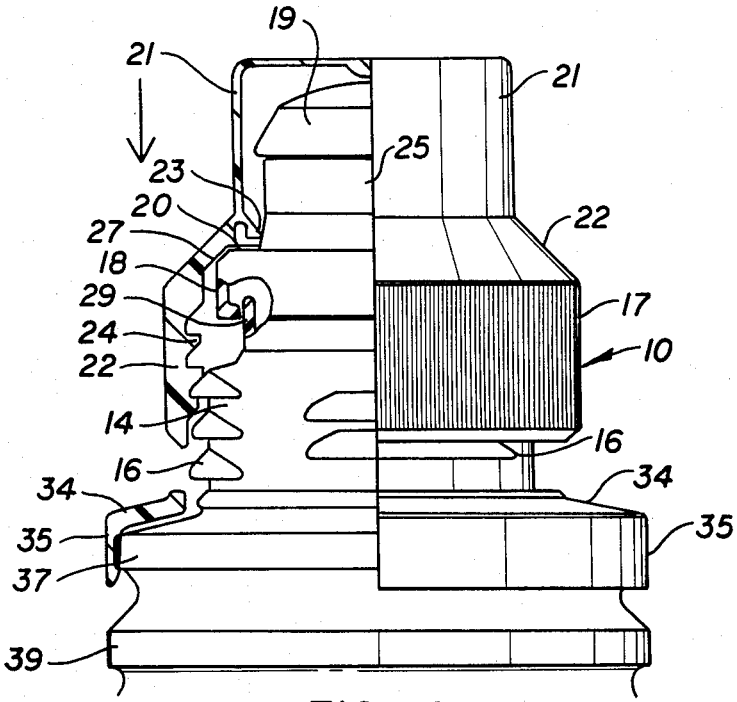
FIG. 4 is a view similar to FIG. 2 illustrating the engagement of the threads of the cap and the container neck.

A better understanding of the advantages of the present tamperproof closure system will be had by a description of its operation. As earlier described, closure 22 will be secured to container 12 and neck 14 in the manner illustrated in FIG. 2. To gain access to the contents of the container, tab 40 will be pulled outwardly and away from cap 22 thereby causing a breaking through weakened portions 31 and 32. This will cause a severing of the band section as illustrated in FIG. 3. With band section 30 removed, closure 22 can be moved in the direction of the container body 12 to thereby cause threads 24 to engage threads 16. This threadable engagement is illustrated in FIG. 4. As the threads engage, it will be seen that angular portion 27 will impact upon ledge portion 20, ultimately rupturing frangible section 26, thereby causing a severing of flange portion 18 as illustrated in FIG. 4.

Figure 5:
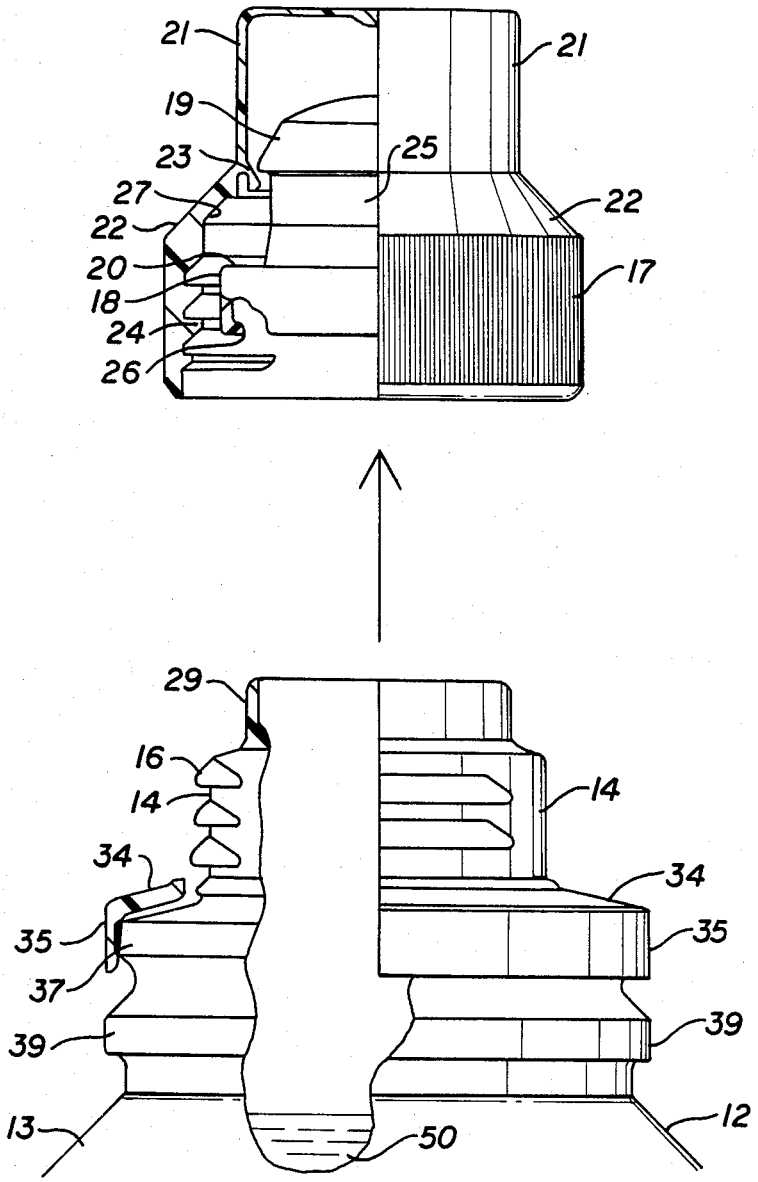
FIG. 5 is a view similar to FIG. 2 except showing the component parts of the container system in a disassembled view and with the top portion of the container captured within the outer cap.

It will be noted that from the initial assembly of cap 22 onto container neck 14, as illustrated in FIG. 2, and during the removal of band 30 as well as engagements of threads 24 and 16, annular projection 23 will be captured in recess 25 provided by dome 19 and ledge portion 20. This feature is best illustrated in FIG. 5 where it will be seen that dome portion 19 as well as flange portion 18 will be carried in cap 22 and separate from container neck 14. This will allow sterile liquid 50 to be expelled from the container. Subsequently, dome portion 19 with flange portion 18 can be reseated onto neck 14 with the engagement of threads 24 in cap 22 and threads 16 on neck 14. This reengagement will in effect place flange portion 18 in contact with wall portion 29 of neck 14.

Container 12 is constructed of a thermoplastic material such as polypropylene. However, other thermoplastic materials such as polyethylene, polyvinylchloride, polyethylene terphthalate, butadiene stryene, acrylics including acrylonitrile, polytetrafluoroethylene, polycarbonates and other thermoplastics. Screw cap 22 may also be fabricated of any of the above described materials with the key factor being that the material of the container neck and the material of the screw cap can be fused by welding techniques.

In the preceding description, a specific captive means was referred to in the positioning of annular projection 23 in recess 25. Any type of captive means can be employed such as semispherical protrusions, extending from cap 22, the only consideration being moldability and interference with dome portion 19. The same is true of the breakaway portion in neck 14 as provided by ledge portion 20 and groove 26 with ledge 20 being contacted by angular portion 27. Other breakaway means could be a concentrated contact point on the cap 22 or neck 14 for rotational engagement with dome portion 19. Neither is the specific type of tearaway feature critical as represented by tear-away band 30. Any means whether internal or external of cap 22 and which would provide for removal of an annular portion of cap 22 between shoulder 34 and threads 24 could be employed.

An important feature of the present invention is the fact that a screw cap member can be positioned over the threads of a blow-fill-seal container in a manner such that machine assembly and sealing techniques which require the relative displacement of the cap with respect to the container are feasible. The tamperproof system of this invention accomplishes a sterile environment, yet without the need of additional sealing devices such as gaskets, O-rings, hot melt procedures or wraparound tape. All of the foregoing advantages of sterility are afforded in a blow-fill-seal container system, yet will permit the reclosing of the container, if desired.

It will thus be seen that through the present invention there is now provided a unique tamperproof closure system for a sterile solution container which will permit machine assembly of the outer cap over the container neck. The closure system avoids premature engagement of the cap and container threads, yet activation of the system is readily afforded by means of a tamper-indicating device. The closure system also isolates the frangible section inherent to blow-fill-seal containers from accidental stress and potential solution seal failure until the time of first use. The container closure system of this invention can be readily manufactured without extensive tooling and can be assembled using readily available assembly equipment. A container system results which can be fabricated at a minimum amount of cost, yet provide maximum sterility protection for the solution.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

What is claimed is:

1. A tamperproof closure system for molded plastic containers having a threaded container neck including a threaded cap capable of being secured to said container neck without threadable engagement comprising:

a screw-type cap member having internal threading, a removal portion and skirt portion;

external threading complementary to said internal threading extending from said container neck;

an abutment surface presented by said container neck for sealable contact with cap skirt portion;

a breakaway portion defined by said container neck;

a contact portion defined by said cap for contact with said breakaway portion; and captive means operatively associated with said cap and said container neck;

said cap and said container neck constructed and arranged so that when said cap skirt portion is sealed to said abutment surface, said threading is placed in a spaced apart position and when said removal portion is removed said threads will engage;

whereby when said threads are engaged, said contact portion of said cap will engage said breakaway portion of said container neck.

2. The tamperproof closure system as defined in claim 1 wherein said skirt portion is joined to said screw-type cap member by a shoulder member.

3. The tamperproof closure system as defined in claim 2 wherein said shoulder member extends outwardly and in a downwardly angular manner with respect to said screw-type cap member.

4. The tamperproof closure system as defined in claim 3 wherein said cap member and said container neck is formed from a thermoplastic resinous material.

5. The tamperproof closure system as defined in claim 4 wherein said sealable contact between said abutment surface and said skirt portion of said cap is a heat fusion weld.

6. The tamperproof closure system as defined in claim 1 wherein said removal portion is defined by a tearaway annular band member.

7. The tamperproof closure system as defined in claim 6 wherein said tearaway band member is joined to said screw-cap type member by spaced apart annular grooves and includes a pull tab extending from said annular band.

8. The tamperproof closure system as defined in claim 1 wherein said container neck includes a dome portion and said captive means is provided by an annular recess in said dome portion and a projection extending from said cap for interference fitment therein.

9. The tamperproof closure system as defined in claim 1 wherein said container neck includes a dome portion and said breakaway portion is provided by a flange portion extending from said dome portion and includes a ledge portion for contact with said contact portion of said cap.

10. The tamperproof closure system as defined in claim 9 wherein said breakaway portion further includes a groove connecting said flange with said dome and positioned opposite said ledge portion.

11. A tamperproof container system for sterile liquids, the container system including a thermoplastic container and a threaded neck with a threaded cap capable of being machine sealed to said container neck without threadable engagement comprising:

a screw-type cap member having internal threading, a removal portion and skirt portion;

external threading complementary to said internal threading extending from said container neck;

an abutment surface presented by said container neck for sealable contact with said cap skirt portion;

a breakaway portion defined by said container neck;

a contact portion defined by said cap for contact with said breakaway portion;

a sterile solution in said container; and captive means operatively associated with said cap and said container neck;

said cap and said container neck constructed and arranged so that when said cap skirt portion is sealed to said abutment surface, said threading is placed in a spaced apart position and when said tear away portion is removed said threads will engage;

whereby when said threads are engaged, said contact portion of said cap will engage said breakaway portion of said container neck.

12. The tamperproof container system as defined in claim 11 wherein said skirt portion is joined to said screw-type cap member by a shoulder member.

13. The tamperproof container system as defined in claim 12 wherein said shoulder member extends outwardly and in a downwardly angular manner with respect to said screw-type cap member.

14. The tamperproof container system as defined in claim 12 wherein said sealable contact between said container neck and said cap skirt portion is provided by spin welding.

15. The tamperproof container system as defined in claim 12 wherein said sealable contact between said container neck and said cap skirt portion is provided by ultrasonic welding.

16. The tamperproof container system as defined in claim 11 wherein said removal portion is defined by a tearaway annular band member and includes a pull tab extending from said annular band.

17. The tamperproof closure system as defined in claim 11 wherein said container neck includes a dome portion and said captive means is provided by an annular recess in said dome portion and a projection extending from said cap for interference fitment therein.

18. The tamperproof container system as defined in claim 11 wherein said container neck includes a dome portion and said breakaway portion is provided by a flange portion extending from said dome portion and includes a ledge portion for contact with said contact portion of said cap.

19. A tamperproof closure for a thermoplastic container having a threaded neck, an abutment surface, a breakaway portion and a cooperative captive receiving member comprising:

a screw-type cap member having internal threading for engagement with said container threaded neck, a removal portion and a skirt portion for sealable contact with said abutment surface;

a contact portion defined by said cap for contact with said container breakaway portion;

cooperative captive means operatively associated with said cap for engagement with said container cooperative captive receiving member;

said cap and said container neck constructed and arranged so that when said cap skirt portion is sealed to said abutment surface, said threading is placed in a spaced apart position and when said tear away portion is removed said threads will engage;

whereby when said threads are engaged, said contact portion of said cap will engage said breakaway portion of said container neck.

20. The tamperproof closure as defined in claim 19 wherein said skirt portion is joined to said cap member by a shoulder member.

* * * * *